US008596373B2

(12) United States Patent
Montgomery et al.

(10) Patent No.: US 8,596,373 B2
(45) Date of Patent: Dec. 3, 2013

(54) METHOD AND APPARATUS FOR RETROFITTING WORK VEHICLE WITH BLADE POSITION SENSING AND CONTROL SYSTEM

(75) Inventors: James Leonard Montgomery, Dubuque, IA (US); Brett Errthum, Asbury, IA (US); Jason Michael Pline, Dubuque, IA (US)

(73) Assignee: Deere & Company, Moline, IL (US)

( * ) Notice: Subject to any disclaimer, the term of this patent is extended or adjusted under 35 U.S.C. 154(b) by 1347 days.

(21) Appl. No.: 11/373,383

(22) Filed: Mar. 10, 2006

(65) Prior Publication Data

US 2007/0284121 A1 Dec. 13, 2007

(51) Int. Cl.
*E02F 3/76* (2006.01)

(52) U.S. Cl.
USPC ..... 172/4.5; 172/2

(58) Field of Classification Search
USPC ..... 172/2, 4, 4.5, 5, 6; 37/348, 382; 701/50
See application file for complete search history.

(56) References Cited

U.S. PATENT DOCUMENTS 2,916,836 A * 12/1959 Stewart et al. ..... 172/4.5
3,494,426 A * 2/1970 Studebaker ..... 172/4.5
3,554,291 A * 1/1971 Rogers et al. ..... 172/4.5
4,537,259 A * 8/1985 Funabashi et al. ..... 172/4.5
4,573,925 A 3/1986 Styers
4,775,953 A 10/1988 Goettelmann
4,805,086 A * 2/1989 Nielsen et al. ..... 700/59
5,375,663 A * 12/1994 Teach ..... 172/4.5
5,462,122 A * 10/1995 Yamamoto et al. ..... 172/2
5,551,524 A * 9/1996 Yamamoto et al. ..... 180/6.62
5,835,088 A 11/1998 Jaaskelainen
5,892,511 A 4/1999 Gelsinger
5,999,176 A 12/1999 Kamper
6,108,076 A * 8/2000 Hanseder ..... 356/141.1
6,112,139 A * 8/2000 Schubert et al. ..... 701/2
6,112,141 A 8/2000 Briffe
6,112,839 A * 9/2000 Ostler et al. ..... 180/53.4
6,189,626 B1 * 2/2001 Hanseder ..... 172/4.5
6,215,490 B1 4/2001 Kaply
6,229,542 B1 5/2001 Miller
6,450,267 B2 * 9/2002 Ohtomo et al. ..... 172/4.5
6,462,757 B1 10/2002 Kao
6,466,235 B1 10/2002 Smith
6,486,799 B1 11/2002 Still
6,512,527 B1 1/2003 Barber
6,518,983 B1 2/2003 Grohmann
6,630,946 B2 10/2003 Elliott
6,654,038 B1 11/2003 Gajewska
6,662,310 B2 12/2003 Lopez
6,739,078 B2 * 5/2004 Morley et al. ..... 37/348
6,782,644 B2 * 8/2004 Fujishima et al. ..... 37/348
6,802,015 B2 10/2004 Atkinson
6,831,666 B1 12/2004 Kreis
6,879,899 B2 * 4/2005 Budde ..... 701/50

(Continued)

OTHER PUBLICATIONS

Brochure re Timbermatic System (16 pages)(2005).

*Primary Examiner* — Matthew D Troutman

(57) ABSTRACT

A work vehicle comprises a blade and a hydraulics system for controlling operation of blade and non-blade functions of the work vehicle. The work vehicle is configured to be retrofitted with a blade position sensing and control system having cooperating onboard and vehicle-remote instrument packages without modification of the hydraulics system. An associated method is disclosed.

7 Claims, 2 Drawing Sheets

(56) References Cited

U.S. PATENT DOCUMENTS

| | | | | |
|---|---|---|---|---|
| 6,985,091 | B2 | 1/2006 | Price | |
| 6,993,722 | B1 | 1/2006 | Greer | |
| 7,121,355 | B2 * | 10/2006 | Lumpkins et al. | 172/4.5 |
| 2002/0162668 | A1 * | 11/2002 | Carlson et al. | 172/4.5 |
| 2004/0186644 | A1 * | 9/2004 | McClure et al. | 701/50 |

* cited by examiner

METHOD AND APPARATUS FOR RETROFITTING WORK VEHICLE WITH BLADE POSITION SENSING AND CONTROL SYSTEM

FIELD OF THE DISCLOSURE

The present disclosure relates to work vehicle blade positioning.

BACKGROUND OF THE DISCLOSURE

Blade position sensing and control systems may be added to work vehicles which have a blade (e.g., dozers, motor graders) for controlling the position of the blade. Examples of such systems are those which are laser-based, GPS-based (Global Positioning System), sonic-based, and combinations thereof. However, retrofitting work vehicles with such systems typically involves modifications to one or more vehicle systems such as the hydraulics system, resulting in cost and time inefficiencies.

SUMMARY OF THE DISCLOSURE

According to the present disclosure, a work vehicle comprises a blade and a hydraulics system for controlling operation of blade and non-blade functions of the work vehicle. The work vehicle is configured to be retrofitted with any one of multiple blade position sensing and control systems, each having cooperating onboard and vehicle-remote instrument packages, without modification of the hydraulics system. As such, the work vehicle can accept different types of blade position sensing and control systems (e.g., laser-based, GPS-based, sonic-based, and combinations thereof without the need to modify the hydraulics system, promoting cost and time efficiencies in the retrofitting process. An associated method is disclosed.

Illustratively, the work vehicle has a network of electronic control units. The network is adaptable to communicate with the onboard instrument package for position control of the blade via a control path leading from the onboard instrument package to the blade through the network.

An electrical interface connector may be used to connect the network and the onboard instrument package. In particular, the electrical interface connector may connect an electronic hydraulics control unit of the network and an operator-interface control unit of the network to an electronic auxiliary control unit of the onboard instrument package. In such a case, blade position information from the blade position sensing and control system may be transmitted to the operator-interface control unit for updating of the worksite graphics map on the computer display screen and may be transmitted to the hydraulics control unit for corresponding control of a valve arrangement responsible for adjustment of the blade functions associated with the blade (e.g., blade tilt, swing, and angle).

The above and other features will become apparent from the following description and the attached drawings.

BRIEF DESCRIPTION OF THE DRAWINGS

The detailed description of the drawings refers to the accompanying figures in which.

DETAILED DESCRIPTION OF THE DRAWINGS

Figure 1:
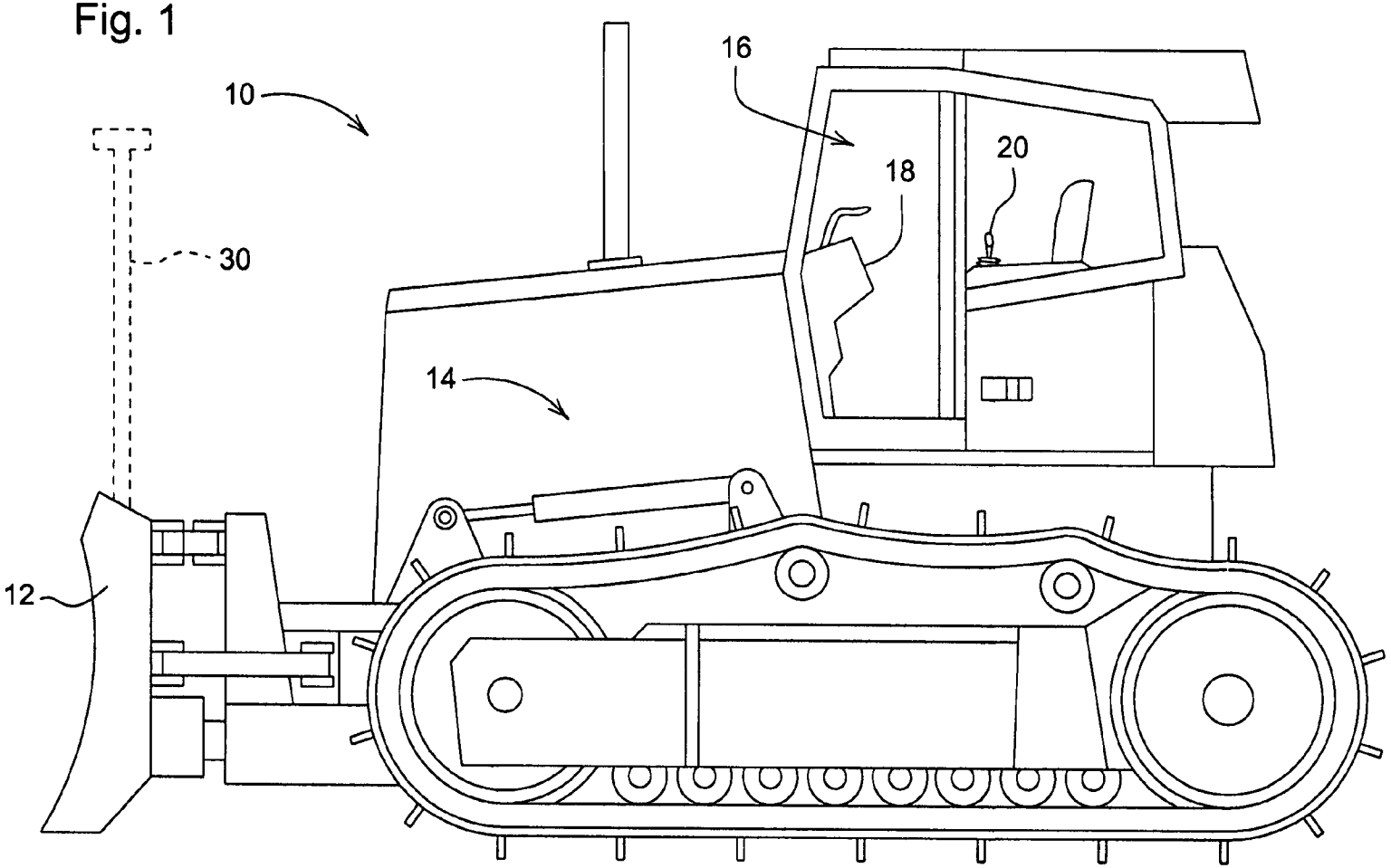
FIG. 1 is a perspective view of a work vehicle exemplarily configured as a crawler dozer.

Referring to FIG. 1, a work vehicle 10 has a blade 12 which may be used for moving material (e.g., dirt, rock) to grade a worksite according to a predetermined grading plan. To facilitate achievement of the desired grade across the worksite, the work vehicle 10 may be retrofitted with any of a number of blade position sensing and control systems. Such systems may be in the form of, for example, a laser-based blade position sensing and control system, a GPS-based blade position sensing and control system, a sonic-based blade position sensing and control system, combinations thereof, or other suitable system. The work vehicle 10 is configured to be retrofitted with any of such systems without modification of the hydraulics system 14 of the vehicle 10.

Illustratively, the vehicle 10 is depicted as a crawler dozer. However, it is to be understood that the vehicle 10 may be configured as other types of work vehicles with earth-moving or other material-moving blades (e.g., wheeled dozer, motor grader). In the crawler dozer example of FIG. 1, the vehicle 10 has an operator's station 16 for an operator of the vehicle 10. At the operator's station 16, there is a display screen 18 for display of application software graphics such as worksite map graphics. An input device 20 (e.g., a joystick) at the operator's station 16 may be used by the operator to control a variety of functions of the vehicle 10 including blade functions (e.g., blade tilt, blade angle, and blade swing).

Figure 2:
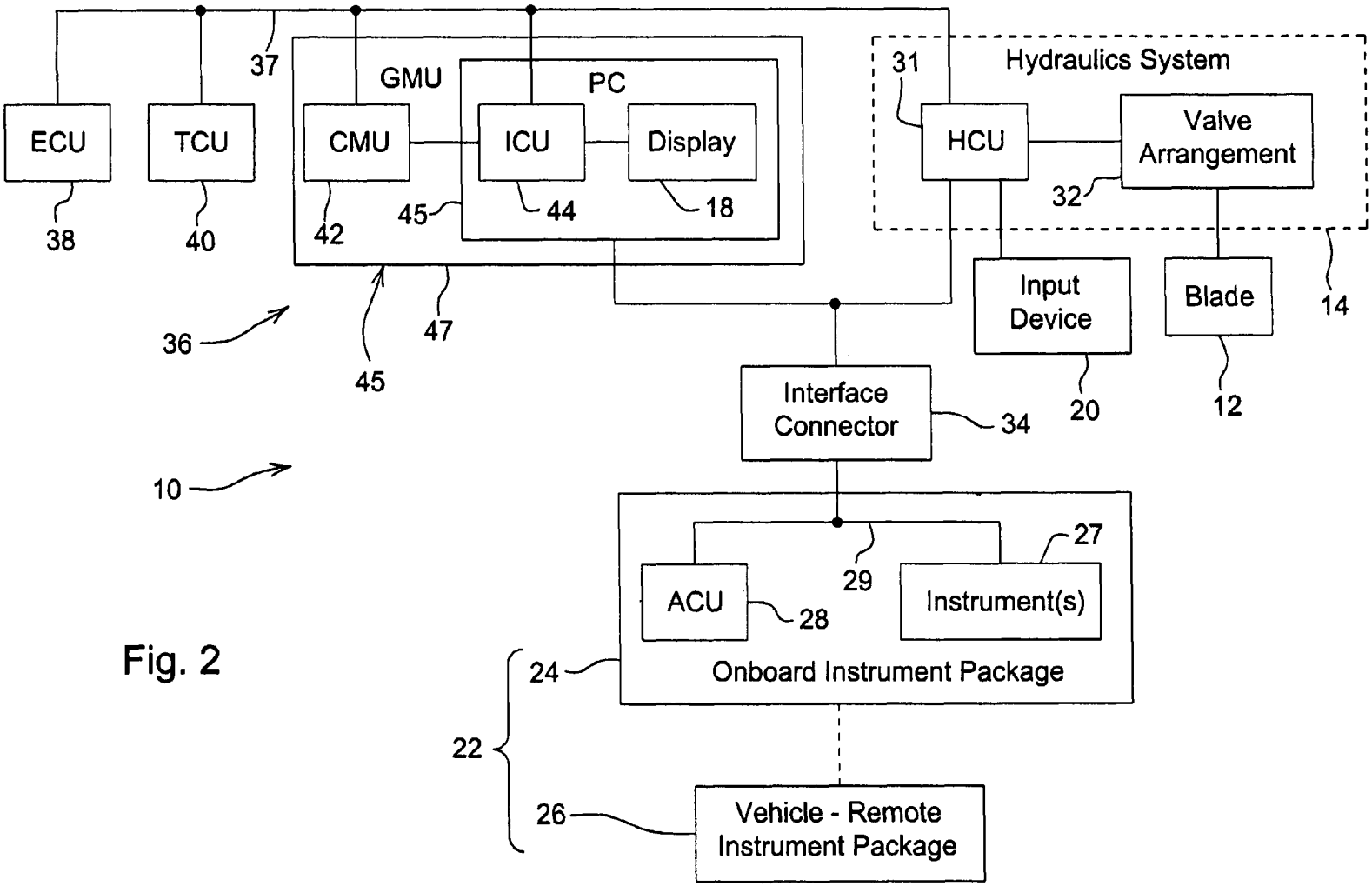
FIG. 2 is a simplified diagram showing the work vehicle retrofitted with a blade position sensing and control system.

Referring to FIG. 2, the vehicle 10 may be retrofitted with a blade position sensing and control system 22 (e.g., laser-based, GPS-based, sonic-based, or combination thereof) for sensing the position of the blade 12 and providing that position information to systems onboard the vehicle 10 for control of the blade position. The system 22 is of the type having an onboard instrument package 24 onboard the vehicle 10 and a vehicle-remote instrument package 26 remote from the vehicle 10.

Depending on the type of system 22 retrofitted onto the vehicle 10, the instrument packages 24, 26 can take a variety of forms. In each case, the onboard instrument package 24 has a number of instruments 27 under the control of an electronic auxiliary control unit 28 via a communications link such as a CAN bus 29. For example, in a laser-based system, the onboard package 24 may have one or more laser receivers mounted onboard the vehicle 10 (e.g., attached to the blade 12 at an end or central region thereof) to receive optical signals transmitted by one or more laser transmitters of the vehicle-remote package 26.

In a GPS-based system, the onboard package 24 may have one or more GPS receivers mounted onboard the vehicle 10 (e.g., attached to the blade 12 at an end or central region thereof) to receive GPS signals from orbitting GPS satellites defining part of the vehicle-remote package 26. The GPS-based system may include real-time kinetic correction for more accurate blade position control in which case the vehicle-remote package 26 may include a GPS receiver at a vehicle-remote, fixed location to receive GPS signals and, based on such signals, transmit a correction signal to an onboard radio receiver of the onboard package 24.

In a sonic-based system, sonic instrumentation onboard and/or offboard the vehicle 10 may be used for blade position control by use of sound emissions (e.g., ultrasonic). The instrument 30 shown in FIG. 1 illustrates a typical possible location for laser and GPS receivers and sonic sensors, i.e., at the ends or central region of the blade and extending upwardly therefrom.

Other instruments may be included in the onboard instrument package 24. For example, one or more inclinometers or operator switches may be added to the vehicle 10.

The vehicle 10 may thus be retrofitted with a variety of blade position sensing and control systems such as any of aforementioned systems or other suitable blade position sensing and control system. Moreover, the vehicle 10 is "retrofit-ready" in the sense that it can accept any of the blade position sensing and control systems without the need to modify the hydraulics system 14 of the vehicle 10. The hydraulics system 14 has an electronic hydraulics control unit 31 ("HCU") (e.g., model HCU/MC400 from Sauer-Danfoss Inc.) for controlling blade functions (e.g., blade tilt, blade swing, and blade lift) and non-blade functions of the vehicle 10 via a valve arrangement 32 of the system 14 (e.g., model PVG100 electrohydraulic valve from Sauer-Danfoss Inc.). Neither the HCU 31 nor the valve arrangement 32 needs to be modified to accept any of the blade position sensing and control systems.

The vehicle 10 has an electrical interface connector 34 adapted to be coupled to the onboard instrument package 24. In other words, when the vehicle 10 is retrofitted with the system 22, the onboard instrument package 24 is attached electrically to the vehicle 10 via the connector 34, which may be configured as a male or female connection head for attachment to a counterpart male or female connection head of the package 24. Exemplarily, the connector 34 is configured as a male connection head having multiple electrical pins.

ACU 28 communicates position information obtained based on signals from the instrument(s) 27 over the interface connector 34 to the HCU 31. The HCU 31 is configured so as to be able to communicate with the ACU 28 of whichever system 22 is selected to be retrofitted to the vehicle 10. Accordingly, the HCU 31 utilizes a command set protocol in common with the auxiliary control unit 28 (e.g., CAN protocol). In response to position signals from the ACU 28, the HCU 31 operates the valve arrangement 32 to adjust the position of the blade 12 (i.e., the attitude of the blade 12 at a given location on the worksite) to achieve the desired grade as the vehicle 10 travels across the worksite A control path for position control of the blade 12 thus leads from the auxiliary control unit 28 through the interface connector 34, the HCU 31, and the valve arrangement 32 to the blade 12. In this way, retrofitting a blade position sensing and control system onto the vehicle 10 need not require adding any new valves or electrical systems to the vehicle 10. Instead, the equipment currently existing on the vehicle 10 can be used with the system 22.

The input device 20 is also coupled to the HCU 31. As such, the HCU 31 is also responsive to input signals generated upon actuation of the input device 20 by the operator to control blade and non-blade functions. The HCU 31 may be one of multiple electronic control units included in a network 36 of electronic control units of the vehicle 10 capable of communicating over a communications link 37 such as the tractor CAN bus of the vehicle 10. The network 36 may thus be described as being adaptable to communicate with the onboard instrument package 24 for position control of the blade 12 via the control path leading from the onboard instrument package 24 to the blade 12 through the network 36

Other electronic control units which may be included in the network 36 are an electronic engine control unit 38 ("ECU") for controlling the vehicle engine, an electronic transmission control unit 40 ("TCU") for controlling the vehicle transmission, an electronic CAN monitor unit 42 ("CMU") for monitoring basic tractor functions (e.g., fuel level, oil level), and an electronic operator-interface control unit 44 for controlling display of various software applications on the display screen 18. Together, the unit 44 and the display screen 18 cooperate to provide a personal computer 45 ("PC"). Further, the CMU 42 and the PC 45 may be contained in a common housing 47 to provide what may be termed a graphical monitor unit 45 ("GMU").

The CMU 42 encodes data and transmits such data to the PC 45 for display on the screen 18. Further, multiple software applications may be stored in the PC 45 for selective display on the screen 18.

The PC 45 is coupled to the interface connector 34. In this way, the ACU 28, when coupled to the connector 34, can transmit position information signals to the PC 45 via the interface connector 34 to update the worksite map graphics displayed on the display screen 18. Software associated with the particular system 22 selected to be retrofitted onto the vehicle 10 may be added to the memory of the PC 45 to facilitate communication between the PC 45 and the ACU 28. As such, the PC 45, like the HCU 31, may utilize the common command set protocol for communication the PC 45 and the HCU 31.

It is to be understood that each of the control units 28, 31, 38, 40, 42, 44 may included include a processor such as a microprocessor and a memory having stored therein instructions, which when executed by the processor, cause the processor to perform the various functions of the respective control unit.

While the disclosure has been illustrated and described in detail in the drawings and foregoing description, such an illustration and description is to be considered as exemplary and not restrictive in character, it being understood that illustrative embodiments have been shown and described and that all changes and modifications that come within the spirit of the disclosure are desired to be protected. It will be noted that alternative embodiments of the present disclosure may not include all of the features described yet still benefit from at least some of the advantages of such features. Those of ordinary skill in the art may readily devise their own implementations that incorporate one or more of the features of the present disclosure and fall within the spirit and scope of the present invention as defined by the appended claims.

The invention claimed is:

1. A method for use with a work vehicle comprising a blade and a hydraulics system for controlling operation of blade and non-blade functions of the work vehicle, the method comprising retrofitting the work vehicle with any one of multiple blade position sensing and control systems, each having cooperating onboard and vehicle-remote instrument packages, without modifying the hydraulics system.

2. The method of claim 1, wherein:

the work vehicle comprises an electrical interface connector, and the retrofitting comprises coupling the onboard instrument package to the electrical interface connector.

3. The method of claim 2, wherein:

the hydraulics system comprises an electronic hydraulics control unit, the onboard instrument package comprises an electronic auxiliary control unit, and the retrofitting comprises interconnecting the hydraulics control unit and the auxiliary control unit via the electrical interface connector.

4. The method of claim 3, wherein:

the hydraulics system comprises a valve arrangement under the control of the hydraulics control unit and associated with the blade for positioning the blade, and the interconnecting comprises establishing a control path leading from the auxiliary control unit through the electrical interface connector, the hydraulics control unit, and the valve arrangement to the blade.

5. The method of claim 3, wherein:

the work vehicle comprises an operator-interface control unit, and the retrofitting comprises interconnecting the operator-interface control unit and the auxiliary control unit via the electrical interface connector.

6. The method of claim 2, wherein:

the work vehicle comprises an operator-interface control unit, and the retrofitting comprises interconnecting the operator-interface control unit and the auxiliary control unit via the electrical interface connector.

7. The method of claim 1, wherein the retrofitting comprises connecting the onboard instrument package to a network of electronic control units onboard the work vehicle for position control of the blade via a control path leading from the onboard instrument package to the blade through the network.

* * * * *